US005897746A

United States Patent [19]

Attenberger et al.

[11] Patent Number: 5,897,746

[45] Date of Patent: Apr. 27, 1999

[54] METHOD FOR EQUIPPING PAPERS OF VALUE WITH AUTHENTICITY FEATURES

[75] Inventors: Thomas Attenberger, Poing; Dieter Stein, Holzkirchen; Gerhard Stenzel, Germering; Wilhelm Ilgmann, Wolfratshausen, all of Germany

[73] Assignee: Giesecke & Devrient, GmbH, Munich, Germany

[21] Appl. No.: 08/824,195

[22] Filed: Mar. 25, 1997

Related U.S. Application Data

[63] Continuation of application No. 08/362,872, Dec. 23, 1994, abandoned.

[30] Foreign Application Priority Data

Dec. 24, 1993 [DE] Germany ..... 43 44 552

[51] Int. Cl.[6] ..... D21H 21/40; D21H 23/24; B44F 1/12

[52] U.S. Cl. ..... 162/140; 162/134; 162/110; 427/185

[58] Field of Search ..... 162/140, 134, 162/263, 110; 283/72, 95, 113, 58, 57, 56; 427/197, 203, 185, 424

[56] References Cited

U.S. PATENT DOCUMENTS

| | | | |
|---|---|---|---|
| 1,281,951 | 10/1918 | Harper | 283/113 X |
| 2,711,120 | 6/1955 | MacLaurin | 162/110 |
| 3,833,467 | 9/1974 | Spiller | 162/181 |
| 3,997,433 | 12/1976 | Liu et al. | 209/5 |
| 4,446,204 | 5/1984 | Kaule et al. | 428/323 |
| 4,504,357 | 3/1985 | Holbein et al. | 162/123 |
| 4,761,204 | 8/1988 | Crane | 162/103 |
| 4,863,783 | 9/1989 | Milton | 428/207 |
| 4,944,960 | 7/1990 | Sundholm et al. | 427/27 |
| 4,964,951 | 10/1990 | Menyhert | 162/140 |
| 5,279,854 | 1/1994 | Kendall et al. | 427/197 |
| 5,324,079 | 6/1994 | Kaule et al. | 283/82 |
| 5,360,516 | 11/1994 | Cutright et al. | 162/139 |

FOREIGN PATENT DOCUMENTS

| | | |
|---|---|---|
| 3525138 | 1/1987 | Germany . |
| 643430 | 9/1950 | United Kingdom . |
| 696673 | 9/1953 | United Kingdom . |
| 2 043 732 | 10/1980 | United Kingdom . |

*Primary Examiner*—Stanley S. Silverman
*Assistant Examiner*—José S. Fortuna
*Attorney, Agent, or Firm*—Bacon & Thomas, PLLC

[57] ABSTRACT

In a method for providing papers of value with authenticity features, a homogeneous mixture is produced in a defined concentration from a feature substance present in powder form and a gas. This mixture is ejected at high speed from at least one nozzle disposed at a given distance from the paper web and transferred onto the running paper web.

7 Claims, 3 Drawing Sheets

METHOD FOR EQUIPPING PAPERS OF VALUE WITH AUTHENTICITY FEATURES

This application is a continuation of application Ser. No. 08/362,872, filed Dec. 23, 1994, now abandoned.

BACKGROUND OF THE INVENTION

The present invention relates to a method for equipping papers of value with authenticity features wherein at least one feature substance is applied in the course of papermaking to a moving, wet paper web, in particular a paper web for making papers of value.

Papers of value in the sense of the invention are bank notes, passports, check forms, shares, documents, postage stamps, airplane tickets and the like. The simplified term "antifalsification paper" or "paper of value" used here will therefore always include documents of the stated type.

Such documents of high value must be uncontestably identifiable with respect to their originality and origin because their material value constitutes only a fraction of their commercial value. Identifiability is obtained for instance by special marks used only for proving authenticity. In the ideal case these authenticity marks cannot be imitated, or only with very great effort, and are not falsifiable. Their presence in the intended form therefore guarantees the authenticity of the antifalsification paper. The closer an authenticity feature comes to the ideal of being "not falsifiable" and "not imitable" the greater its value for ensuring authenticity is.

In the past particularly those authenticity features have proven useful which can only be incorporated in the antifalsification paper during production. Such features are e.g. watermarks, safeguarding threads, chemically reacting additives and mottling fibers.

These features are particularly suitable for the visual authenticity testing of antifalsification papers usually performed. Although these features are visually recognizable they guarantee high security because the paper equipped with them can only be produced with elaborate machines to which the forger has no access and whose purchase or construction is not worth it economically for purposes of forgery.

Along with features identifiable visually by the human eye and without aids, antifalsification papers have also been equipped for some time with features identifiable only using special devices With this type of feature the forger has the additional problem of first having to identify the feature or its special properties, whereby identification can be made even more difficult by incorporating the features in the paper solely at precisely defined places.

GB-C 696 673 discloses a method for producing papers of value wherein authenticity features are produced in the form of color patterns within a paper web by injecting a colorant, pigment or ink in solution or suspension into the arising fibrous web in the pulp of a one-cylinder machine at a place where sheet forming has progressed about one half. Direct injection of the feature substances into the pulp, however, exposes them to the currents and eddies present in a rotating cylinder machine. The resulting thorough mingling of the incorporated feature substances with the pulp causes the pulp to be enriched or dyed homogeneously with the injected colorant as time increases, so that the arising paper is finally dyed or provided with feature substances in its total substance.

GB-C 643 430 further discloses a method for producing a paper web provided with a watermark. To produce the possibly colored watermark an endless metal band is guided above the arising paper web of an endless wire machine and moves at the same speed as the arising paper web. The metal band is provided with recesses in the form of the desired watermarks. The diffuse spraying of colorants onto the inner side of the metal band produces the watermark since the colorant can be deposited on the paper web only in the areas of the recesses. This method involves the disadvantage that, firstly, certain shapes can only be applied by templates and, secondly, the colorants are fed to the moist paper web with the aid of solvents so that the paper web is additionally moistened at these places. Altering the water regime, i.e. the addition or release of liquid, can crucially impair the properties of the paper. The local addition of liquid alters the consistency of the paper in these areas so that the location of the applied feature can be detected. Also, for low feature concentrations one cannot ensure that the feature substance is applied in the necessary homogeneous distribution when the feature is applied to the paper with the aid of a liquid as a medium Furthermore, when the colorants are applied with liquid media there is a danger of the fibrous structure of the paper web being visibly changed due to an excessive jet pressure.

Finally DE-C 29 05 441 discloses a method wherein features, such as colorants or chemicals, are incorporated in certain places within a paper web. In a first step a first paper web is produced and the feature substance, dissolved in liquid, applied to one of the surfaces of this paper web using an ink jet printer. In a second method step the side of this first paper web treated with the feature substance is covered with a second, separately produced paper web.

BRIEF SUMMARY OF THE INVENTION

The present invention is based on the problem of proposing a paper of value and a method and apparatus for producing it wherein feature substances can be incorporated in locally limited fashion in a defined shape and concentration without visibly changing the fibrous structure of the paper.

The basic idea of the invention is that, in a first method step, a feature substance present in a powder form is mixed with a gas in such a way that agglomerates of feature particles break down easily and the particles are then present and held in the gas in a defined homogeneous concentration. In a second method step the wet paper web is subjected to the mixture via a nozzle in such a way that the feature particles hit the paper in the free gas jet with a relatively sharply limited scattering cone.

The inventive method makes it possible for the first time to provide a paper web along one or more tracks with a feature substance present in the paper in homogeneous distribution even at very low concentration over large production batches. Furthermore the method ensures that no changes in paper structure are visible on the finished paper web.

What is essential for this success is the use of a powdery feature substance that can be held in homogeneous distribution in a gas even in very low concentration and that is transferred onto the wet web via at least one nozzle positioned a certain distance from the paper web. For the distance between the nozzle and the paper web one can define two limits that should not be fallen short of or exceeded. The minimum distance between nozzle and paper web should be large enough for the paper web not to touch the nozzle even if there fluctuations perpendicular to the direction of transport. The maximum distance is dependent on various parameters, including the outlet rate of the gas/feature mixture from the nozzle, and on the size, shape and weight of the individual particles. At given parameters the distance is selected so that the paper web is subjected to a directed particle stream, the particles hitting the paper web at a speed sufficient to anchor the particles firmly in the paper stuff.

For the concentration of the feature in the paper the adjustable parameters include, along with the feature concentration, throughput in time through the nozzle, average particle size, average fiber length of the paper, place of incorporation or water content of the paper web and speed of the running paper web.

The inventive method also makes it possible to apply characters and patterns to a paper web with relatively sharp contours without the use of templates.

BRIEF DESCRIPTION OF THE DRAWINGS

Further advantages and advantageous developments of the invention are the object of the subclaims and the content of the description with reference to the figures, in which:

DETAILED DESCRIPTION

Figure 1:
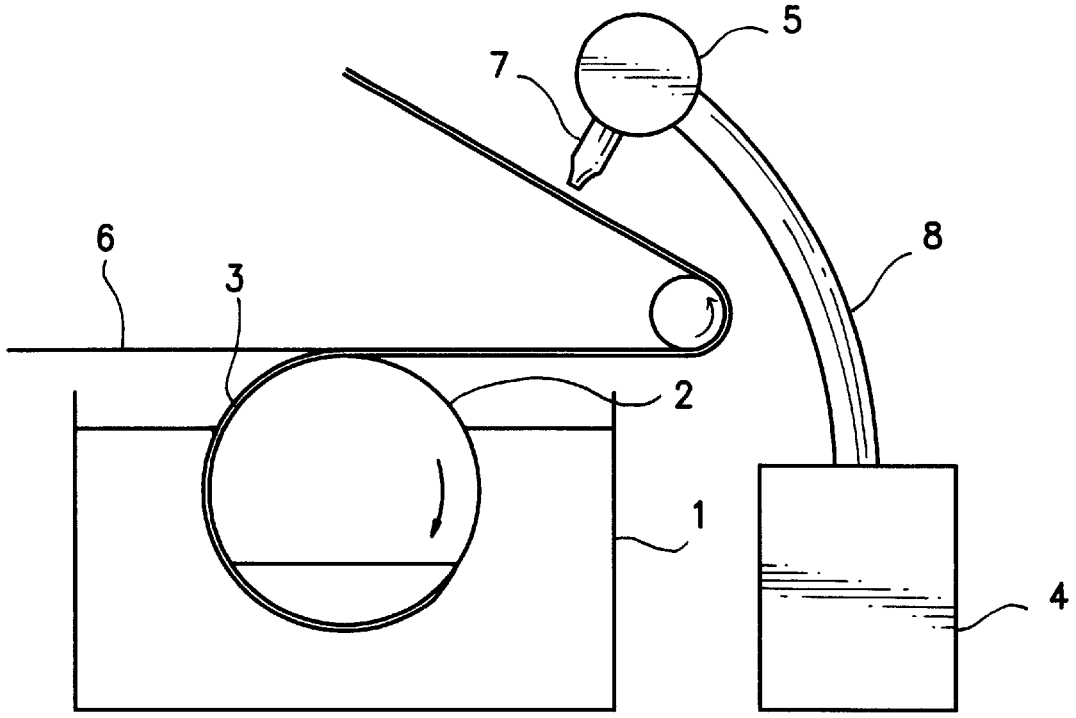
FIG. 1 shows the schematic representation of a cylinder machine for producing an antifalsification paper.

FIG. 1 shows schematically a cylinder machine as is typically used for producing antifalsification papers. In paper machine 1 paper web 3 is formed on wire 2, being removed by pick-up felt 6 and transported away. The gas/feature mixture is produced in unit 4, which will be dealt with below, and guided via pipe system 8, distributing and drive system 5, to nozzles 7. The mixture leaves the nozzles at high speed so that the feature substance passes onto the paper web which is still wet at this place. The stated components and in particular the nozzles can be installed at different places in the production process. The greatly schematized arrangement in FIG. 1 is merely an example.

Figure 2:
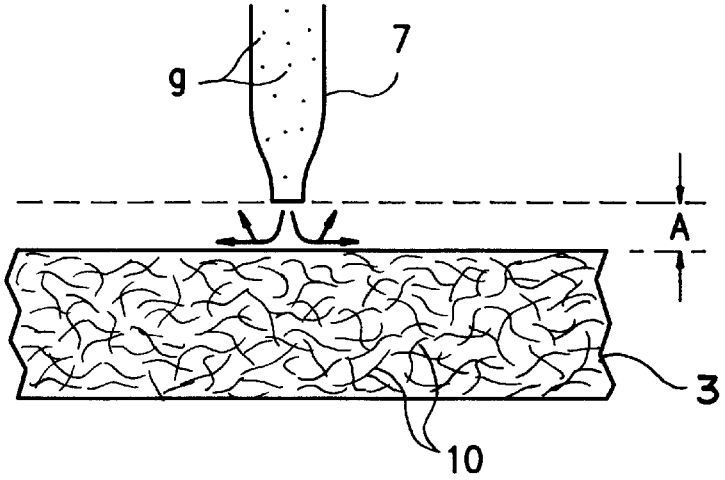
FIG. 2 shows a detail from FIG. 1 in the area of a nozzle.

FIG. 2 shows a detail from FIG. 1 in the area of the nozzle opening. Distance A to be maintained from the nozzle opening to the paper web is determined substantially by the outlet rate of the gas and the shape and size of the feature substance. One should fundamentally make sure that the distance is at least large enough to prevent the paper web from being damaged by the effluent gas/feature mixture. At an outlet rate between 100 and 300 m/s and a particle size between 0.1 and 20 microns a value between 0.5 and 5 cm should be set for distance A. Along with maintaining this maximum distance one should furthermore take into consideration that the distance must be at least large enough so that any motion of the paper web perpendicular to the direction of transport at this place does not lead to the web touching the nozzle, which could thereby clog easily. The above-mentioned outlet rates of the feature particles from the nozzle and predetermined distance A ensure that the particles hit the paper web at a speed that guarantees they are embedded in the paper. The impact speed of the particles can be up to 200 m/s depending on particle size and nozzle configuration. A visible change in the paper web is nevertheless avoided firstly because of the small size of the particles and secondly because of the small concentration of particles in the gas stream.

While the effluent gas is removed on the paper web without impairing it, one portion of the feature substances can penetrate weakly into the interior of the moist paper web, the amount depending on the length and type of fibers 10 and the diameter of applied feature substances 9. A second portion, however, bonds firmly with the surface of the paper web, probably due to adhesive power. The subsequent method steps do not remove these two portions of the feature substances from the paper which remains as a track or tracks along the paper web extending in a given direction. Furthermore there is a third portion of feature substances which adheres loosely to the surface of the paper web, where it is removed by subsequent production steps in papermaking.

Suitable feature substances are all materials that can be produced in powder form and are recognizable visually or by machine, i.e. have a physically measurable or detectable effect. Along with colorants one can use in particular substances having fluorescent, magnetic or electric properties or a combination of these properties.

Figure 3:
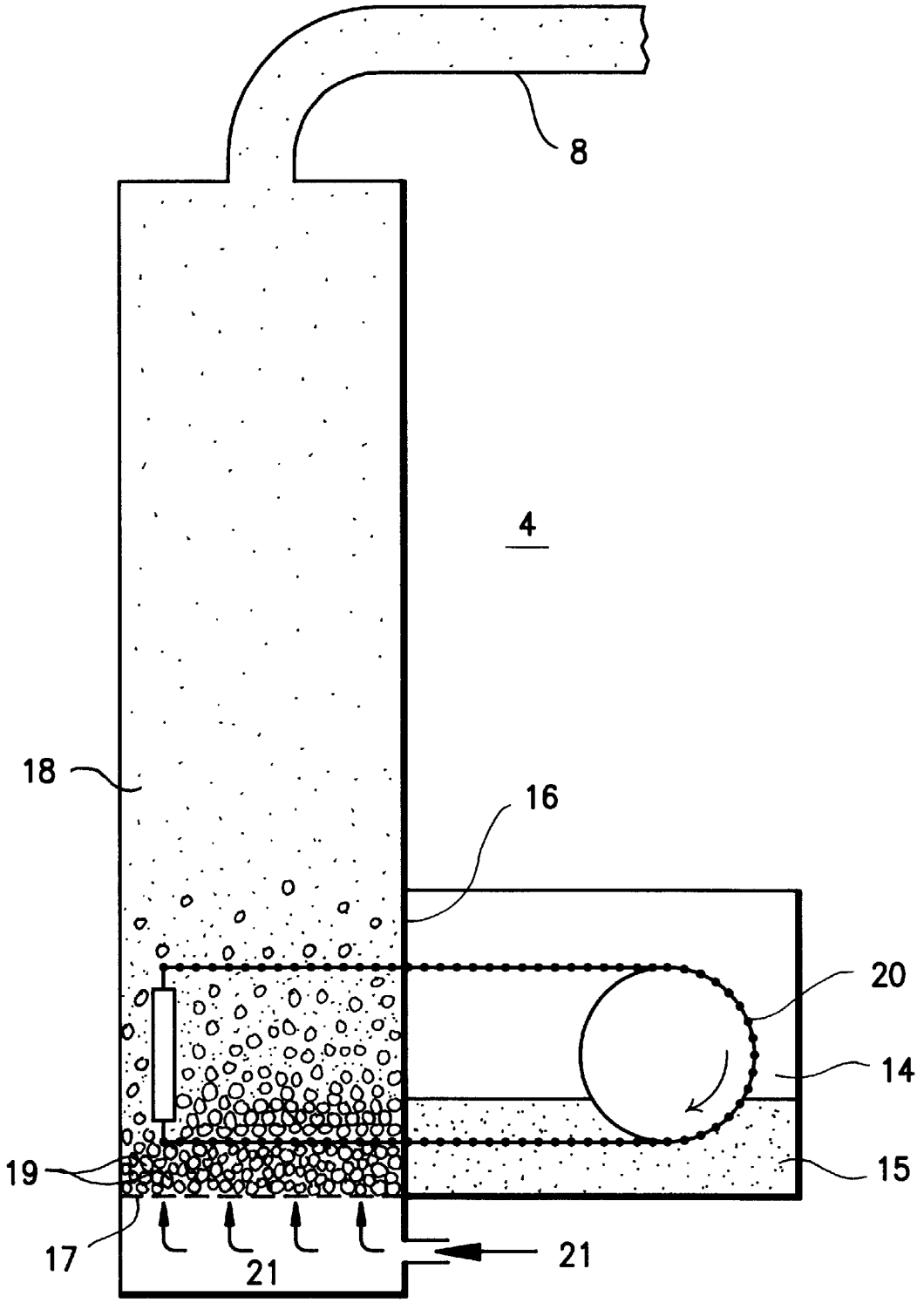
FIG. 3 shows the schematic representation of an apparatus for producing a homogeneous air/powder mixture.

Unit 4 for producing the gas/feature mixture can comprise for example a so-called fluid bed generator, which is shown schematically in FIG. 3. The fundamental mode of functioning of a fluid bed generator is described e.g. in U.S. Pat. No. 3,997,433. Store tank 14 contains a reservoir of feature powder 15. Separated by wall 16, coarse material 19 is located in so-called aerosol chamber 18, preferably comprising spherical particles whose size is selected so that they can penetrate neither openings 38 present in wall 16 nor the pores of partly permeable wall 17. Via conveying means 20, which may be for example a chain or worm conveyor, the feature substance is fed constantly to the coarse material in small dosages. Via gas-permeable wall 17 gas stream 21 of an inert gas is fed to the aerosol chamber so that, firstly, agglomerates of the feature substances are ground and crushed on the coarse material and, secondly, the crushed feature substances are conducted by the gas stream into pipe system 8.

The coarse material is selected so that it cannot pass into pipe system 8 through applied gas stream 21 due to its own weight. The feature substance, on the other hand, is pulled upward by the gas stream, leaving the fluid bed generator with the gas in homogeneous distribution and a given concentration. Parameters available for adjusting the concentration of the feature substance in the gas include the pressure of gas stream 21 and the output of the chain or worm conveyor. Concentrations of the feature in the gas can be produced in unit 4 in a wide range. This range is typically from 5 $mg/m^3$ to 50 $g/m^3$ and is determined essentially by the flow rate of the chain or worm metering means. For incorporating feature substances in paper it has proven favorable to use for the coarse material a material that shows virtually no abrasion, so that no foreign particles are incorporated in the paper with the feature substances. However this problem can also be solved by selecting the coarse material from the same material as that of the feature substance, i.e. only its grain size differs from that of the feature substance to be incorporated. It has also turned out that one can also use as coarse material substances which are already added to the pulp during its production, such as crystalline bleaches. When selecting the coarse material, however, one must always make sure substances are used that have at least the same hardness as the feature substances so that the abrasion on the coarse material is as low as possible and at the same time agglomerates of the feature powder are split open by collisions with the coarse material. For the gas stream one can use gases that are inert with respect to the feature powder and the coarse material, i.e. enter into no chemical reaction with them. In particular one can use nitrogen, argon and air.

To prevent feature powder from being deposited on the walls of the fluid bed generator it is possible to provide the fluid bed generator with a vibration-generating motor at a suitable place. This measure firstly reduces the probability of feature particles being deposited on the walls at all and, secondly, causes feature particles already deposited to be detached from the walls again. For generating vibrations one can use e.g. electric or pneumatic vibrators, compressed-air interval rappers or the like. Depending on the physical properties of the feature powder used, the vibrator should be operated in a frequency range between 20 and 150 Hz. The vibrator can be mounted at basically any place on the outside of the fluid bed generator. It then transmits the generated vibrations to the housing. It is also possible to couple an interval rapper to the base plate of the fluid bed generator; this has the further advantage that a far greater part of the plant can be set vibrating.

However, since the connection of vibrators can also have an adverse effect on the conveyor for the fine material, resulting in an irregular flow rate or a dependency of the flow rate on the vibrator frequency, it is advantageous to couple the vibrator on the outside of the upper part of the fluid bed generator. Furthermore the vibration to the conveyor unit can then be damped or completely interrupted by suitable measures. For this purpose the part of the fluid bed generator set vibrating can be mechanically decoupled from the rest of the plant by an elastic separator for example.

To prevent vibration nodes from forming on the housing which would permit feature powder to be deposited on the walls, one can mount a plurality of vibrators or rappers with different frequencies at various places on the fluid bed generator.

To apply the feature powder to the paper web in a special shape it can be favorable to replace nozzle 7 by a plurality of nozzles. Also an apparatus can be mounted that permits individual nozzles to be driven selectively so that, firstly, the number of nozzles and, secondly, the possibility of driving, i.e. opening or closing, each nozzle singly provide a possibility to apply the feature substance to the paper web in the form of a coding.

Figure 4:
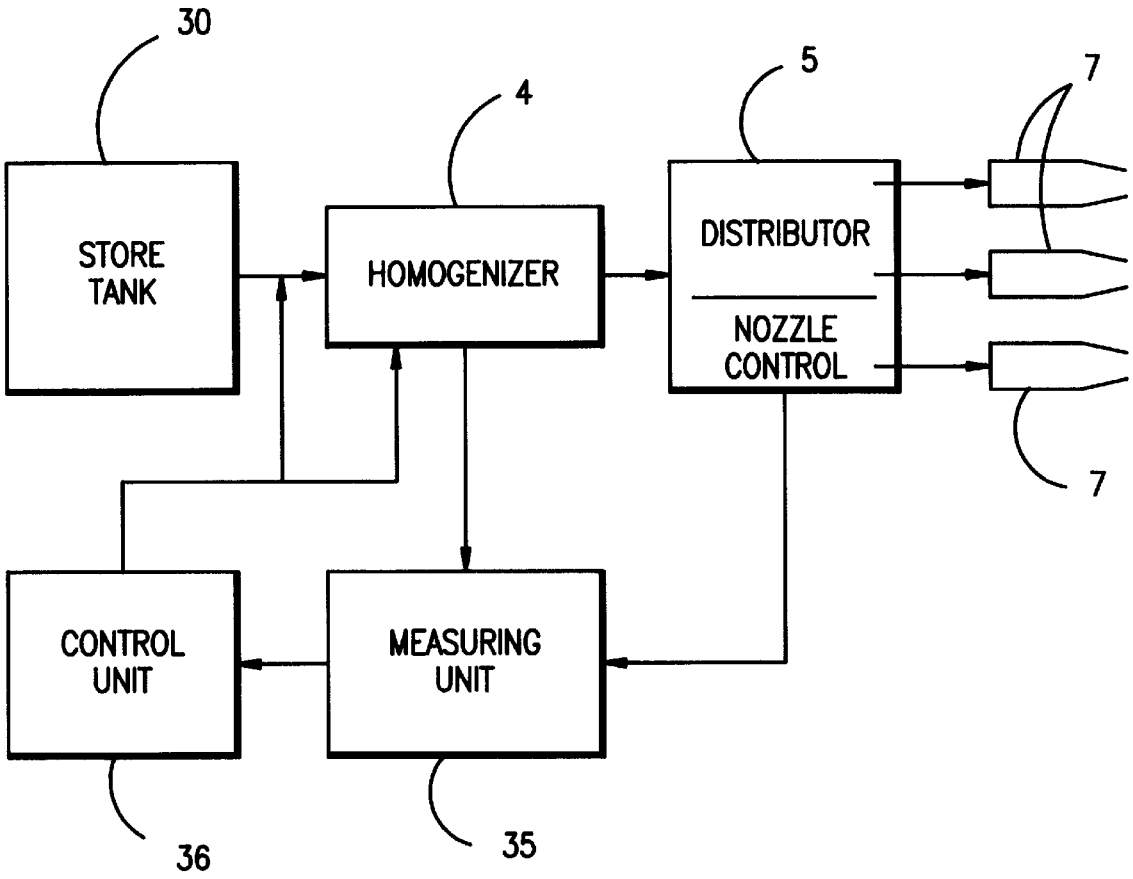
FIG. 4 shows the schematic course for incorporating the feature substances in an antifalsification paper.

FIG. 4 shows the course of the method schematically. The feature substance passes from store tank 30 into homogenizer 4 that produces fine feature particles and incorporates them with a gas in the desired, adjustable concentration. The homogeneous mixture passes via distributor 5 to one or more nozzles 33, whereby a control unit can also be present for driving the opening of the nozzles singly or else in groups. Measuring unit 35, which detects the actual concentration of the feature substance in the gas or another relevant variable, makes it possible to produce a regulation signal due to which control unit 36 influences the feed of the feature substance from the store tank or directly the variable parameters of the homogenizer so as to compensate deviations from the adjusted gas/feature concentration. Depending on local circumstances the concentration can be measured at various places, e.g. in the homogenizer, at the nozzle exit or in the distributor.

The homogeneous gas/feature mixture is then fed optionally via a distributor and under the influence of a nozzle control unit to one or more nozzles from which the feature particles emerge at high speed together with the gas stream, the outlet rate of the feature particles being below that of the gas.

By selecting the nozzle geometry and the air throughput of the nozzles one can fix the outlet rate of the feature particles. It must be such that the speed of the particles when hitting the paper web is high enough to ensure that they penetrate into the web or adhere to the surface.

After the feature substance is applied to the paper web the web is subjected to the customary further treatment, e.g. sizing, drying or couching. This aftertreating method firstly increases the quality of the paper of value. Secondly it removes those feature particles from the web which adhere only weakly to it. After sizing, the feature substances are fixed in their final position and can be tested for their particular physical properties as particles applied in defined fashion.

We claim:

1. A method for providing documents with authenticity features wherein at least one feature substance is applied to a moving, wet paper web in the course of papermaking, comprising the steps of:

preparing a homogenous mixture of a gas and a feature substance in powder form in a predetermined concentration of feature substance to gas in a fluid bed generator;

feeding the mixture to at least one nozzle disposed at a selected distance from the wet paper web; and discharging the mixture from the at least one nozzle directly onto the wet paper web in the form of a directed particle stream.

2. The method of claim 1, wherein said distance is between 0.5 and 5 cm; said particles have a mean diameter of 0.1 to 20 microns; and the gas/feature mixture is discharged from the nozzle at an outlet rate between 100 and 300 m/s.

3. The method of claim 1, wherein the gas used is selected from the group consisting of nitrogen, argon and air.

4. The method of claim 1, wherein the concentration of the powder in the gas when emerging from the nozzle is 10 $mg/m^3$ to 10 $g/m^3$.

5. The method of claim 1, including discharging the feature substance onto the web by means of a plurality of nozzles.

6. The method of claim 5, including arranging the nozzles such that the feature substance stream is discharged in the form of a code.

7. The method of claim 1 including vibrating at least part of the fluid bed generator by a vibration generating motor while the homogenous mixture is being prepared.

* * * * *